US008554099B2

(12) United States Patent
Kitagawa

(10) Patent No.: US 8,554,099 B2
(45) Date of Patent: Oct. 8, 2013

(54) IMAGE HEATING APPARATUS FOR COOLING THE SURFACES OF AN IMAGE HEATING DEVICE AND A PRESSING DEVICE PRESSING AGAINST THE HEATING DEVICE TO FORM A NIP

(75) Inventor: Oki Kitagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 13/190,956

(22) Filed: Jul. 26, 2011

(65) Prior Publication Data

US 2012/0027444 A1 Feb. 2, 2012

(30) Foreign Application Priority Data

Jul. 28, 2010 (JP) ..... 2010-169158

(51) Int. Cl.
*G03G 15/20* (2006.01)

(52) U.S. Cl.
USPC ..... 399/69; 399/92

(58) Field of Classification Search
USPC ..... 399/69, 328, 320, 92, 94; 219/216
See application file for complete search history.

(56) References Cited

U.S. PATENT DOCUMENTS

| | | | | |
|---|---|---|---|---|
| 5,956,554 | A * | 9/1999 | Yanashima et al. | 399/328 |
| 7,106,986 | B2 | 9/2006 | Nakayama | |
| 2006/0088326 | A1 | 4/2006 | Nakayama | |
| 2009/0226200 | A1 * | 9/2009 | Ando | 399/69 |
| 2010/0284706 | A1 * | 11/2010 | Ito et al. | 399/69 |
| 2010/0322667 | A1 | 12/2010 | Kitagawa | |

FOREIGN PATENT DOCUMENTS

JP 2006-119430 5/2006

* cited by examiner

*Primary Examiner* — Sophia S Chen
(74) *Attorney, Agent, or Firm* — Fitzpatrick, Cella, Harper & Scinto

(57) ABSTRACT

An image heating apparatus includes a heater, a pressor, first and second temperature sensors, a controller, first and said coolers for cooling a surface of the heater and the pressor, respectively, a contact-spacing device for establishing a contact state of the heater and pressor and a spaced state of the heater and the pressor, a portion for executing first and second cooling modes in which at least one of the coolers is operated while rotating the heater and pressor in the contact state and in which the first and second coolers are operated while rotating the heater and pressor in the spaced state, respectively, and a selector for selecting the first cooling mode or the second cooling mode on the basis of an output of the second temperature sensor.

5 Claims, 7 Drawing Sheets

IMAGE HEATING APPARATUS FOR COOLING THE SURFACES OF AN IMAGE HEATING DEVICE AND A PRESSING DEVICE PRESSING AGAINST THE HEATING DEVICE TO FORM A NIP

FIELD OF THE INVENTION AND RELATED ART

The present invention relates to an image heating apparatus for heating an image on recording medium. In particular, it relates to an image heat apparatus mounted in an image forming apparatus for forming an image on recording medium with the use of an electrophotographic image forming method, for example.

Generally, an electrophotographic image forming apparatus such as a copying machine, a printer, a facsimile machine, and a multifunction image forming apparatus capable of performing two or more functions of the preceding image forming apparatuses, or the like, forms an image with the use of the following method. That is, it has a toner image forming means made up of a charging device, an exposing device, a developing device, etc., and forms an unfixed toner image on its image bearing means such as a photosensitive drum and an intermediary transferring member. Then, it transfers the unfixed toner image on the image bearing member onto a recording medium, such as a sheet of paper, with the use of its transferring means. Then, it fixes the unfixed toner image on the recording medium to the recording medium with the use of its fixing device (image heating device).

A fixing device has a fixing member and a pressure applying member, which are pressed against each other to form a fixation nip, through which a sheet of the recording medium, on which a toner image is present, is conveyed, remaining pinched between the fixing member and the pressure applying member, while the fixing device is controlled so that the temperature of the fixing member remains no less than the melting point of the toner. Thus, the unfixed toner image on the sheet of the recording medium is fixed to the sheet of the recording medium by the heat and pressure applied to the sheet of the recording medium and the toner image thereon by the fixing device. In a case of a fixing device for a high-speed image forming apparatus, in order to ensure that even when a substantial number of prints are continuously made, each sheet of the recording medium and the unfixed toner image thereon are supplied with a sufficient amount of heat, not only the fixing member, but also the pressure applying member are controlled in temperature to prevent the fixing member from decreasing in temperature while a substantial number of sheets of the recording medium are continuously conveyed through the fixing device. However, the target temperature for the pressure applying member is lower than the target temperature for the fixing member.

One of the common practices to keep an ordinary image forming apparatus as high as possible in productivity is to provide the apparatus with a fixing device whose fixation temperature (target temperature) can be adjusted in several steps according to the recording-medium type (basis weight, surface properties, etc.). Generally, if the recording medium is a sheet of uncoated paper, the target temperature is set to a level that is satisfactory from both the standpoint of properties related to conveyance (how easily it wrinkles, how easily it separates from the fixing member and the pressure applying member), and the standpoint of image properties (fixation quality, toner offset, glossiness, and the like). That is, the greater in basis weight the recording medium, the higher the level to which the target temperature is set. In comparison, in a case where the recording medium is a sheet of coated paper, that is, paper, the surface of which is coated with resin or the like substance, not only is the target temperature set to ensure that the device desirably performs from the standpoint of the above-described basic factors (recording-medium conveyance, image properties), but also, to prevent recording-medium conveyance failure peculiar to coated paper, and the formation of unsatisfactory images. More concretely, for example, in the case of a fixing device, the pressure applying member is in the form of a roller, and therefore, the fixation nip is relatively narrow in terms of the recording-medium conveyance direction. If the peripheral surface temperature of the roller that contacts the opposite surface of the recording medium (coated paper) from the image bearing surface of the recording medium, becomes excessive, it is possible that "blistering" will occur, which is the phenomenon that a toner image formed on the coated surface of the recording medium is disturbed by the steam which broke through the coated layer after being generated within the recording medium. Further, in the case of a fixing device that forms its fixation nip with its pressure applying belt, and a stationary member, which is on the inward side of the loop that the pressure applying belt forms, if the belt becomes excessive in temperature, it is possible that the recording-medium conveyance failure attributable to the reduction in the amount of friction between the pressure applying belt and the opposite surface of the recording medium from the image bearing surface, which is traceable also to the steam in the nip, will occur, and/or that images that are nonuniform in glossiness will be outputted.

An image forming apparatus, whose fixing device is enabled to be changed in several steps in fixation temperature (target temperature) for the above-described reasons, suffers from the problem that it has to be kept on standby for a certain length of time after the fixation temperature (target temperature) of the fixing device is changed in. That is, for example, in a case where an image forming apparatus is kept on standby, with the temperature of the fixing member of its fixing device being kept at the normal fixation-temperature level, and then, an image forming operation for forming an image on a thinnest sheet of paper usable by a given image forming apparatus is started, or in a case where multiple sheets of a recording medium, which are different in type (thin sheets of a recording medium and thick sheets of a recording medium, for example) are continuously and alternately fed, the length of time required to adjust the fixing device in fixation temperature becomes substantial; "down time" increases. In other words, in the situations such as those described above, the image forming apparatus drastically decreases in productivity, which is undesirable from the standpoint of usability. In particular, this problem is likely to be exacerbated by a high-speed image forming apparatus. That is, in a case of a high-speed image forming apparatus, a large number of sheets of a recording medium are likely to be continuously conveyed though its fixing device in a short length of time. Therefore, in order to prevent its fixing member from decreasing in temperature during an image forming operation, it has to be provided with a fixing member that is substantial in thermal capacity. Thus, the length of time required to cool the fixing member sometimes becomes longer than the length of time required to heat it, which is likely to significantly affect the overall productivity of the image forming apparatus.

As one of the conventional means for cooling a fixing member, there is the technology disclosed in Japanese Laid-open Patent Application 2006-119430. According to this patent application, which relates to a fixing apparatus that forms a fixation nip with a fixation roller and a pressure applying belt, the pressure applying belt is provided with a cooling means, and when it is necessary to cool the fixation roller, the pressure applying belt is pressed upon the fixation roller to cool the fixation roller, whereas when it is necessary to cool the pressure applying belt, the belt is separated from the fixation roller before it is cooled.

The technology disclosed in Japanese Laid-open Patent Application, however, suffers from the following problem. That is, if it is necessary to cool the fixation roller when the pressure applying belt is high in temperature, the pressure applying belt has to be cooled after it cooled the fixation roller. In other words, the operation for cooling the fixation roller, and the operation for cooling the pressure applying belt, have to be separately carried out. In other words, this technology is likely to increase an image forming apparatus in "down time".

SUMMARY OF THE INVENTION

The primary object of the present invention is to provide an image forming apparatus which is significantly shorter in the length of time required to cool the first and second image heating means of its fixing device than any image forming apparatus in accordance with the prior art.

According to an aspect of the present invention, there is provided an image heating apparatus for heating an image on a recording material, the apparatus comprising image heating device for heating an image on the recording material; a pressing device pressing against first image heating device to form a nip for nipping and feeding the recording material; a first temperature detecting member for detecting a temperature of the image heating device; an electric power supply control portion for controlling electric power supply to the image heating device in accordance with an output of the temperature detecting member so that a temperature of the image heating device is a target temperature; a second temperature detecting member for detecting a temperature of the pressing device; a first cooling device for cooling a surface of the image heating device; a second cooling device for cooling a surface of the pressing device; a contact-spacing device for establishing a contact state in which the image heating device and the pressing device are contacted with each other and a spaced state in which the image heating device and the pressing device are spaced from each other; an executing portion for executing a first cooling mode operation in which at least one of the cooling device is operated while rotating the image heating device and the pressing device in the contact state and a second cooling mode operation in which the first cooling device and the second cooling device are operated while rotating the image heating device and the pressing device in the spaced state; and a selector for selecting from cooling modes including the first cooling mode and the second cooling mode on the basis of an output of the second temperature detecting member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Description of Example of Image Forming Apparatus

Figure 1:
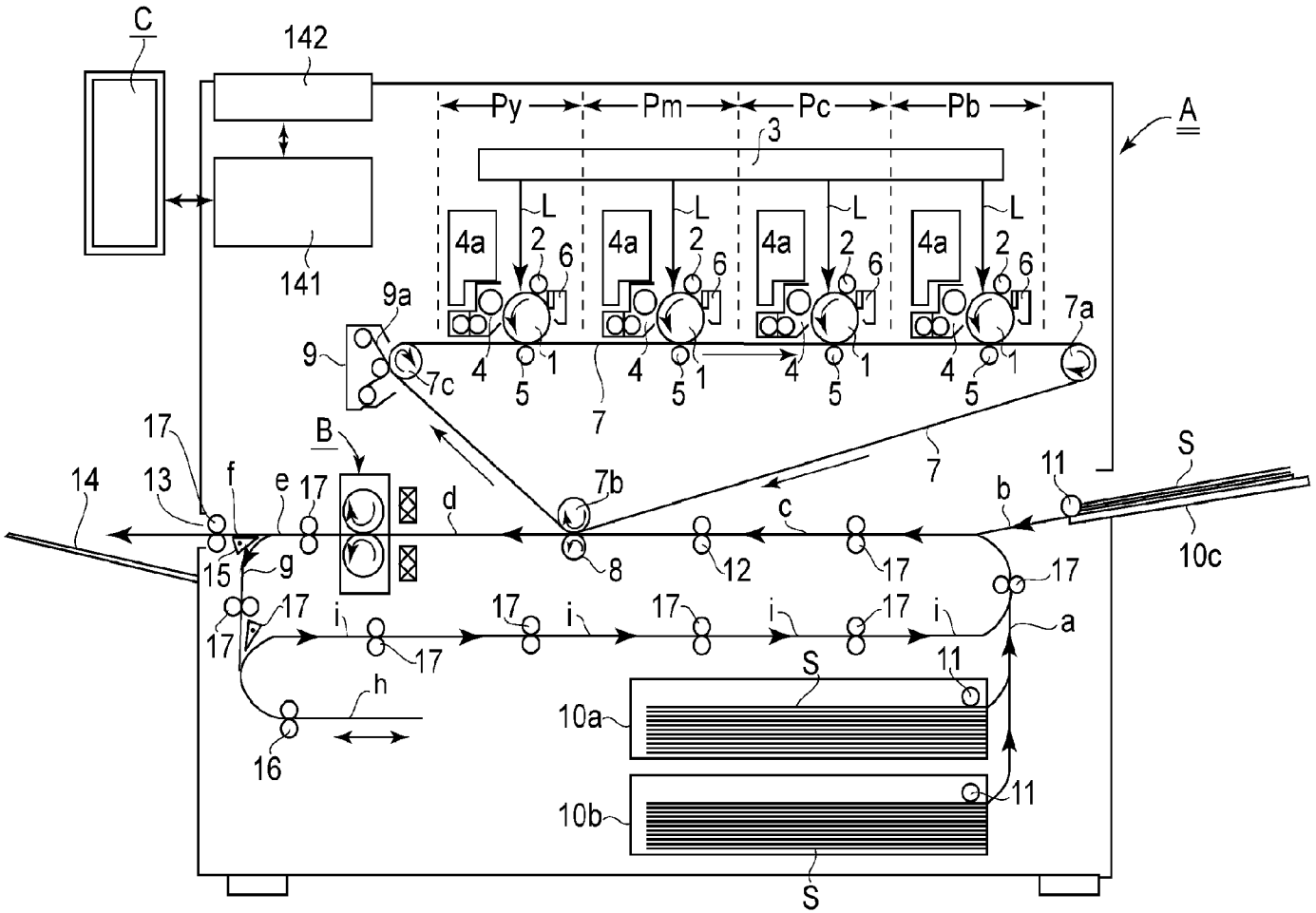
FIG. 1 is a schematic vertical sectional view of the image forming apparatus in the first preferred embodiment of the present invention.

FIG. 1 is a schematic vertical sectional view of the image forming apparatus A which has a fixing device B in accordance with the present invention. This apparatus A is an electrophotographic color printer based on four primary colors. It forms a color image on a sheet S of a recording medium, based on the electrical information about the image to be formed, information about the recording medium, information about the print to be made, and the like, which are inputted into the controller 141 of the apparatus A from a host apparatus C, or the control panel 14 of the apparatus A. The host apparatus C is a personal computer, an image reader, a facsimile machine (from which information is sent), etc., for example.

The apparatus A in this embodiment is 380 mm/sec in process speed, and is capable of forming 80 prints of size A4 per minute. It has first to fourth image forming stations P (Py, Pm, Pc and Pb), which are sequentially arranged in parallel in the top portion of the main assembly of the apparatus A. The four image forming stations P are capable of forming a monochromatic toner image (image formed of toner), through charging, exposing, developing, and transferring processes. They are different in the color of the monochromatic toner image they form. In this embodiment, the first, second, third, and fourth image forming stations Py, Pm, Pc, and Pb form yellow (Y), magenta (M), cyan (C), and black (B) toner images, respectively. The controller 141 starts an image forming operation in response to a print start command inputted from the host apparatus C or through the control panel 142, and follows the preset image formation sequence. More concretely, the four image forming stations P are sequentially driven. In each image forming station P, an electrophotographic photosensitive drum 1 (which hereafter is referred to simply as drum 1) as an image bearing member is rotated in the counterclockwise direction indicated by an arrow mark at a preset peripheral velocity (process speed). The apparatus A is provided with an intermediary transfer belt 7 (toner-image transferring intermediary member), which is suspended and kept stretched by a belt driving roller 7*a*, a second transfer roller 7*b*, and a tension roller 7*c*, in such a manner that they remain in contact with the drum 1 of each of the four image forming stations P. The intermediary transfer belt 7 is circularly moved by the belt driving roller 7*a* in the clockwise direction indicated by arrow marks at a speed that corresponds to the peripheral velocity of the drum 1. As the image formation sequence is started, first, the peripheral surface of the drum 1 is uniformly charged by a first charging device 2 to a preset polarity and potential level, in the first image forming station Py. Then, the uniformly charged portion of the peripheral surface of the drum 1 is scanned by (exposed to) a beam L of laser light outputted by the exposing device while being modulated with the information of the image to be formed. Thus, an electrostatic latent image, which reflects the information of the image to be formed, is formed on the peripheral surface of the drum 1. More specifically, the exposing device 3 in this embodiment is such an apparatus that scans the charged portion of the peripheral surface of the drum 1 with the beam of laser light which it projects. Although not shown in FIG. 1, the beam L (light flux) of laser light emitted from the light source is moved by rotating the polygonal mirror, in such a manner that as the beam is deflected by the polygonal mirror, it scans the generatrix of the drum 1 while being focused on the generatrix by an f-θ lens. Then, the latent image formed on the drum 1 is developed by the developing device 4 which uses yellow toner (developer); a visible image is formed on the peripheral surface of the drum 1, of the yellow toner (developer). Designated by reference characters 4*a* is a device that supplies the developing device 4 with toner. Processes similar to the charging, exposing, and developing processes carried out in the first image forming station Py are carried out also in each of the second, third, and fourth image forming stations Pm, Pc, and Pb, respectively. After the formation of the yellow (Y), magenta (M), and black (B) toner images in the image forming stations Py, Pm, and Pb, respectively, the three images are sequentially transferred in layers onto the outward surface (in terms of loop belt 7 forms) by the first transfer rollers 5 (first charging device for transfer), which oppose the drums 1, with the belt 7 being pinched between the transfer rollers 5 and drums 1, one for one. In each image forming station P, the area of contact between the drum 1 and belt 7 is the first transfer area. To the roller 5, a preset voltage is applied as the first transfer bias. The polarity of the first transfer bias is opposite to the intrinsic polarity of toner. More specifically, the toner image on the drum 1 is transferred onto the belt 7 by the combination of the electric field formed by the bias applied to the first transfer roller 5, and the contact pressure between the drum 1 and belt 7. As the four monochromatic toner images, different in color, are transferred in layers onto the belt 7 as described above, a full-color image is formed of the four monochromatic toner images, on the belt 7. Also in each image forming station P, after the transfer of the toner image onto the belt 7, the toner remaining on the peripheral surface of the drum 1 is removed by a drum cleaner 6, so that the peripheral surface of the drum 1 can be repeatedly used for image formation. There is an outside second transfer roller 8, which opposes the inside second transfer roller 7*b*, with the belt 7 being pinched by the rollers 8 and 7*a*. The area of contact between the belt 7 and roller 8 is the second transfer area. The apparatus A is also provided with a belt cleaner 9, which is positioned so that its cleaning member 9*a* contacts the belt 7 in the area where the belt 7 wraps around the tension roller 7*c*. The belt cleaner 9 in this embodiment is a cleaner of the so-called web type. That is, the cleaning member 9*a* of the cleaner 9 is a piece of web (unwoven cloth).

The main assembly of the apparatus A is provided with a first sheet feeder cassette 10*a*, a second sheet feeder cassette 10*b*, and a manual feed tray 10*c* (multipurpose tray). As one of the abovementioned sheet feeding means is selected, the feed roller 11 of the selected sheet feeding means is driven, whereby one of the sheets of the recording medium in the selected sheet feeding means is fed into the main assembly of the apparatus A while being separated from the rest. Then, the sheet S of the recording medium is made to enter a sheet path c through a sheet path a or b, and then, is sent to a pair of registration roller 12. Then, the sheet S of the recording medium is introduced into the second transfer area by the rollers 12 with a preset control timing so that the further conveyance of the sheet S synchronizes with the toner image formation in each image forming station P. Then, the sheet S is conveyed through the second transfer area while remaining pinched by the belt 7 and outside second transfer roller 8. While the sheet S is conveyed through the second transfer area, the second transfer bias, that is, a preset voltage, the polarity of which is opposite to the intrinsic polarity of the toner, is applied to the roller 8. Thus, the full-color toner image, that is, the layered four monochromatic images, different in color, on the belt 7 is transferred together (second transfer) onto the sheet S of the recording medium as if it is peeled away from the belt 7 starting from the leading edge of the image in terms of the moving direction of the belt 7. More specifically, it is by the combination of the electric field generated by the abovementioned bias applied to the roller 8, and the contact pressure between the sheet S of recording medium and belt 7. After being conveyed out of the second transfer area, the sheet S of the recording medium is separated from the surface of the belt 7, and is introduced into a fixing device 7 through a sheet path d. After the separation of the sheet S from the belt 7, the outward surface of the belt 7 is cleaned by the belt cleaner 9: unwanted substances such as the toner, paper dust, and the like, remaining on the outward surface of the belt 7 after the second transfer, are removed by the cleaner 9 so that the belt 7 can be repeatedly used for intermediary transfer.

The second transfer bias, that is, the bias applied to the outer second transfer roller 8, is controlled by the controller 141 according to the condition (in terms of temperature and humidity) of the ambience of the apparatus A, and the properties (basis weight, surface properties) of the recording medium used for image formation. Further, during the sheet intervals when two or more sheets S of the recording medium are continuously conveyed through the second transfer area, and at the end of each image forming operation, the bias applied to the outer second transfer roller 8 is controlled. More concretely, during the abovementioned periods, a transfer bias (second transfer bias) which is the same in polarity as the intrinsic polarity of the toner is applied to the outer second transfer roller 8 for a preset length of time. With the application of this bias, the toner particles on the outer second transfer roller 8 (toner particles which scattered and adhered to roller 8, fog causing toner particles, etc.) are returned to the belt 7 to prevent the roller 8 from decreasing in transfer performance, and also, to prevent the sheet S of the recording medium from being soiled on the backside.

As the sheet S of the recording medium is introduced into, and conveyed through, the fixing device B, the sheet S and the unfixed toner image thereon are subjected to heat and pressure. Thus, the unfixed toner image becomes fixed to the sheet S. When the apparatus A is in the one-side print mode, after the sheet S of the recording medium is conveyed out of the fixing device B, it is conveyed through sheet paths e and f, and is discharged into a delivery tray 14 through a sheet discharge opening 13. When the apparatus A is used to output two or more prints (when apparatus A is in a continuous printing mode), an image forming operation such as the one described above is repeated for a number of times equal to the number of prints wanted. In a case where the apparatus A is in the two-side print mode, as a sheet S of the recording medium is conveyed out of the fixing device B after the formation of an image on one (first surface) of the two surfaces of the sheet S, the sheet S is guided by a first flapper 15 from the sheet path e into a sheet path g, and then, into a switch-back sheet path h. Then, the sheet S is introduced into the re-conveyance sheet path i from the switch-back sheet path h by the combination of the reverse driving of a switch back roller 16 and the movement of the second flapper 15. As the sheet S is moved from the switch-back path h into the re-conveyance path i, the sheet S is positioned so that its second surface, that is, the opposite surface from the first surface of the sheet S, that is, the surface having the toner image, will face the belt 7 in the second transfer area. Then, the sheet S is conveyed through the sheet path i, and is introduced into the sheet path c through the sheet path a for the second time. Then, a toner image is transferred onto the second surface of the sheet S. Thereafter, the sheet S is conveyed as it is when the apparatus A is in the one-side printing mode. That is, it is conveyed through the sheet path d, the fixing device B, the sheet path e, and the sheet path f, and then, is discharged as a two-side print into the delivery tray 14 through the sheet discharge opening 13. Incidentally, the sheet paths a-i are provided with multiple recording-medium conveyance rollers 17. The number of the rollers 17 is optional.

Figure 2:
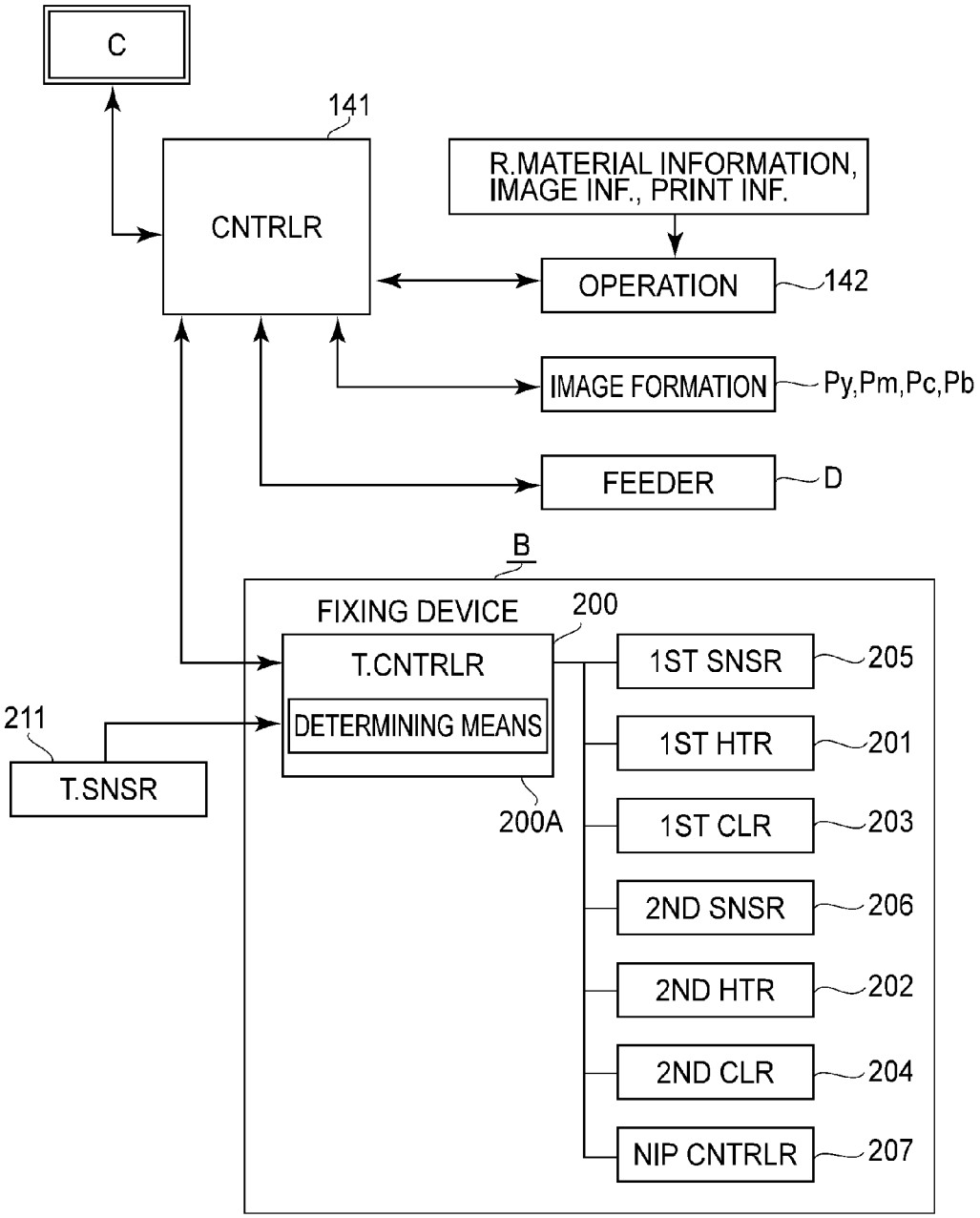
FIG. 2 is a block diagram of the control system of the image forming apparatus in the first preferred embodiment.

FIG. 2 is a block diagram of the control system of the apparatus A. Typically, the controller 141 is a CPU (control circuit). It exchanges various electrical information with the host apparatus C and control panel 142. It integrally controls the image forming operation of the apparatus A according to a preset control program and referential tables. That is, the controller 141 integrally controls the overall operation of the apparatus A by observing the operation of each of the various sections of the apparatus A, and coordinating the command systems among the various operational units of the apparatus A. The control panel 142 is an interface through which a user can access the apparatus A. That is, the control panel 142 can be used by a user to carry out not only basic tasks such as inputting the information of a printing job (basis weight of the recording medium, image density, print count, etc.), but also, complicated tasks such as setting the apparatus A for the so-called "mixed job", that is, a job in which multiple prints are continuously outputted while switching the recording medium. A recording medium conveying means D is a part of the recording-medium conveyance system. It comprises: the sheet feeder roller 11, the conveyance rollers 17, the registration rollers 12, the switch-back roller 16, the flappers 15 and 17, etc.

(2) Fixing Device B

Figure 3:
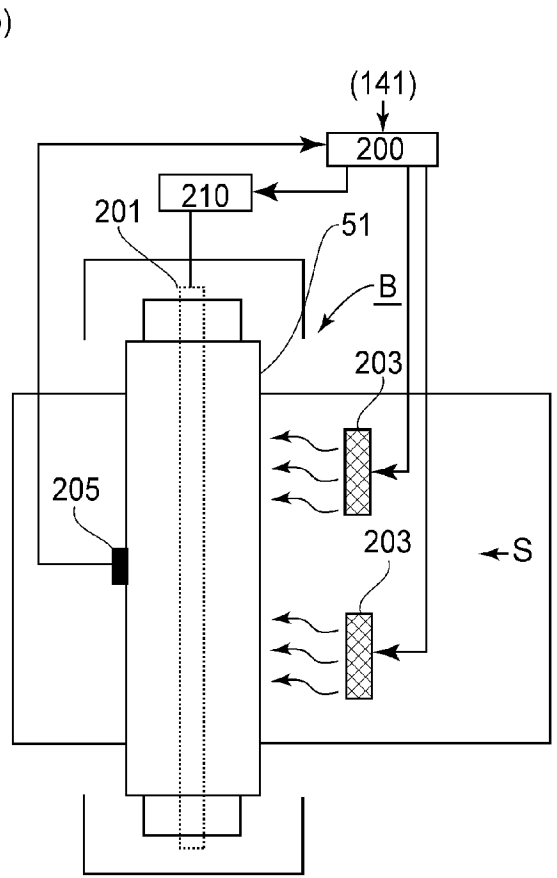
FIG. 3 is a drawing for illustrating the structure of the fixing device in the first preferred embodiment.
Figure 3:
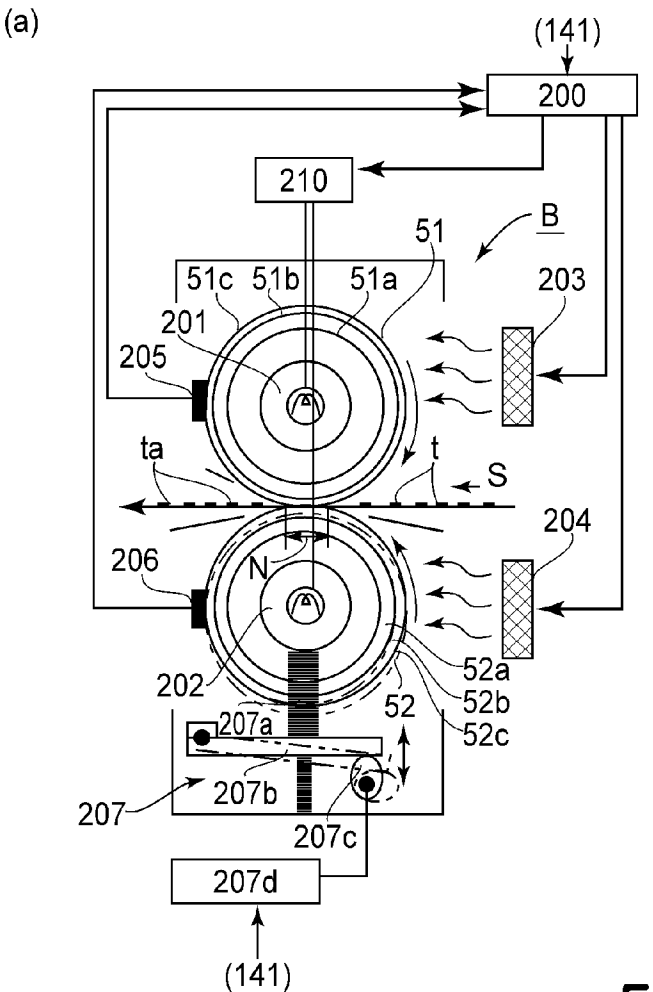

FIG. 3(*a*) is a schematic cross-sectional view of the fixing device B. The fixing device B in this embodiment is of the so-called roller type. Designated by a reference numeral 51 is a fixation roller as the first fixing member (first image heating member), and is rotatable. Designated by a reference numeral 52 is a pressure applying roller as the second fixing member (second image heating member), and is also rotatable. The fixing member 51 is on the top side the pressure roller 52. The two rollers 51 and 52 are parallel to each other, and are kept pressed against each other with the application of a preset amount of pressure so that a nip N (fixation nip), which is preset in with in terms of the recording-medium conveyance direction, is formed and maintained between the two rollers 51 and 52. The two rollers 51 and 52 are rotated by a driving means (unshown) at a preset speed in the direction indicated by the arrow marks. The sheet S of recording medium, on which an unfixed toner image t is present, is introduced into the fixation nip N from the right-hand side of the nip N in the drawing, being positioned so that the toner-image bearing surface of the sheet S faces the fixation roller 51. Then, the sheet S is conveyed through the fixation nip N while remaining pinched by the two rollers 51 and 52. Thus, as the sheet S is conveyed through the fixation nip N, the sheet S and the unfixed toner image t thereon are subjected to heat and pressure, whereby the unfixed toner image t is fixed to the sheet S. That is, the unfixed toner image t becomes a fixed toner image ta. The fixation roller 51 is the primary fixing means that thermally fixes the unfixed toner image t to the sheet S, whereas the pressure roller 52 is the pressure applying means, which is kept pressed upon the fixing means (fixation roller 51) to form and maintain the nip N through which the sheet S of recording medium is conveyed while remaining pinched by the two rollers 51 and 52.

In this embodiment, the fixation roller 51 is made up of a cylindrical metallic core 51*a*, an elastic layer 51*b*, and a parting layer 51*c*. The metallic core 51*a* is made of iron, and is 72 mm in external diameter. The elastic layer 51*b* is formed of silicon rubber, and 4 mm in thickness. It covers virtually the entirety of the peripheral surface of the metallic core 51*a*. The parting layer 51*c* is a piece of PFA tube, and is 30 μm in thickness. It covers the entirety of the peripheral surface of the elastic layer 51*b*. As for pressure roller 52, it is made up of a cylindrical metallic core 52*a*, an elastic layer 52*b*, and a parting layer 52*c*. The metallic core 52*a* is made of iron, and is 76 mm in external diameter. The elastic layer 52*b* is formed of silicon rubber, and 2 mm in thickness. It covers virtually the entirety of the peripheral surface of the metallic core 52*a*. The parting layer 52*c* is a piece of PFA tube, and is 30 μm in thickness. It covers the entirety of the peripheral surface of the elastic layer 52*b*. There is a halogen heater 201 in the hollow of the cylindrical metallic core 51*a* of the fixation roller 51. The halogen heater 201 is the first heating means (heat source), that is, the heating means for heating the fixation roller 51. Further, there is a halogen heater 202 in the hollow of the cylindrical metallic core 52*a* of the pressure roller 52. The halogen heater 202 is the second heating means (heat source), that is, the heating means for heating the pressure roller 52. Further, the fixing device B is provided with a thermistor 205 as the first temperature detecting means, that is, the temperature detecting means for detecting the surface temperature of the roller 51. In terms of the rotational direction of the fixation roller 51, the thermistor 205 is on the downstream side of the nip N. In terms of the lengthwise direction (direction of axial line) of the fixation roller 51, the thermistor 205 is at the midpoint of the fixation roller 51. The thermistor 205 is in contact with, or in the immediate adjacencies of, the peripheral surface of the fixation roller 51. Further, the fixing device B is provided with a thermistor 206 as the second temperature detecting means (second temperature detecting member), that is, the temperature detecting means for detecting the surface temperature of the pressure roller 52. In terms of the rotational direction of the pressure roller 52, the thermistor 206 is on the downstream side of the nip N. In terms of the lengthwise direction (direction of axial line) of the pressure roller 52, the thermistor 206 is at the midpoint of the pressure roller 52. The thermistor 206 is in contact with, or in the immediate adjacencies of, the peripheral surface of the pressure roller 52. The surface temperatures of the fixation roller 51 and pressure roller 52 detected by the thermistors 205 and 206, respectively, are inputted into a temperature controlling means 200 (electric power supply controlling portion), which is under the control of the controller 141. The temperature controlling means 200 controls the electric power supplied to the halogen heaters 201 and 202 from an electric power source 210, based on the information about the surface temperatures of the fixation roller 51 and pressure roller 52. More specifically, it controls the electric power so that the information about the surface temperatures of the fixation roller 51 and pressure roller 52 inputted from the thermistors 205 and 206, that is, the surface temperatures of the fixation roller 51 and pressure roller 52 remain at their target levels, respectively. That is, the fixing device B is controlled so that the surface temperature of the fixation roller 51 and that of the pressure roller 52 remain at preset levels (target temperatures), respectively.

Further, the apparatus A is provided with fans 203 and 204 as the first and second cooling means, respectively. The fan 203 is for cooling the peripheral surface of the fixation roller 51 to change (control) the fixation roller 51 in surface temperature while no sheet S of the recording medium is conveyed through the fixation nip N. In terms of the rotational direction of the fixation roller 51, the fan 203 is on the upstream side of the nip N. The fan 204 is for cooling the peripheral surface of the pressure roller 52 to change (control) the pressure roller 52 in surface temperature while no sheet S is conveyed through the fixation nip N. In terms of the rotational direction of the pressure roller 52, the fan 204 is on the upstream side of the nip N. In the case of the fixing device B in this embodiment, the two fans 203 are in alignment with each other in the direction parallel to the axial line of the fixation roller 51, and so are the two fans, and so are the two fans 304, as shown in FIG. 3(*b*). The two fans 203 are simultaneously turned on or off by the temperature controlling means 200. The fixing apparatus B may be provided with four fans 203, which are aligned in the direction parallel to the lengthwise direction of the fixation roller 51 so that the two fans which correspond in position to the lengthwise ends of the fixation roller 51 can be used to prevent the lengthwise end portions of the fixation roller 51 from excessively increasing in temperature while a small (narrow) sheet S of the recording medium is conveyed through the fixation nip N. Although unillustrated in FIG. 3(*b*), the fixing device B is also provided with two fans 204 and 204 for cooling the pressure roller 52. The fans 204 and 204 are aligned in the direction parallel to the lengthwise direction of the pressure roller 52 in the similar manner as the fans 203 and 203 for the fixation roller 51 are. The two fans 204 and 204 are simultaneously turned on or off by the temperature controlling means 200. The fixing apparatus B may be provided four fans 204, which are aligned in the direction parallel to the lengthwise direction of the pressure roller 52 so that the two fans 204 which correspond in position to the lengthwise ends of the pressure roller 52 can be used to prevent the end portions of the pressure roller 52 from excessively increase in temperature while a small (narrow) sheet S of recording medium is conveyed through the nip N.

Further, the fixing device B is provided with a pressure roller moving means 207 for keeping the pressure roller 52 pressed upon, or separated from, the fixation roller 51. More specifically, the fixation roller 51 is rotatably supported by the fixing device frame (unshown): the lengthwise ends of the metallic core of the fixation roller 51 are supported by a pair of bearings (unshown) positioned between the fixing device frame and the lengthwise ends of the metallic core. In terms of the direction perpendicular to the lengthwise direction of the fixation roller 51, the fixation roller 51 is not movable. As for the pressure roller 52, it is rotatably supported by the fixing device frame, with the presence of a pair of bearings between the pressure roller 52 and fixing-device frame. In terms of the direction perpendicular to the lengthwise direction of the pressure roller 52, however, the pressure roller 52 is slidable for pressing the pressure roller 52 upon the fixation roller 51, and for separating the pressure roller 52 from the fixation roller 51. More concretely, the pressure roller 52 is slidably movable by the aforementioned pressure roller moving means 207 in the direction perpendicular to its axial line, to be pressed upon the fixation roller 51, and also, to be separated from the fixation roller 51. The pressure roller moving means 207 has: a lever 207*b*; a spring 207*a* which is between the lever 207*b* and the bearing of the pressure roller 52; a cam 207*c* for tilting the lever 207*b* upward or downward; and a cam driving mechanism 207*d*, which is controlled by the temperature control means 200. As the cam 207*c* is rotated into its upright position (contoured by a solid line) by the cam driving mechanism 207*d*, the lever 207*b* is tilted upward by the cam 207*c*, causing thereby the spring 207*a* to be compressed between the lever 207*b* and the bearing of the pressure roller 52. Thus, the resiliency of the spring 207*a* keeps the pressure roller 52 pressed upon the fixation roller 51 so that a preset amount of pressure is maintained between the pressure roller 52 and fixation roller 51. In other words, the nip N (fixation nip), which is preset in width in terms of the recording-medium conveyance direction, is formed between the two rollers 51 and 52. Then, as the cam 207*c* is rotated by the cam driving mechanism 207*d* into its horizontal position (contoured by a two-dot chain line), the lever 207*b* is tilted downward by the resiliency of the spring 207*a*. Thus, the spring 207*a* stops pressing the pressure roller 52 upward. Consequently, the pressure roller 52 is moved downward by its own weight, separating therefore from the fixation roller 51: the nip N is made to vanish. As described above, by driving the cam 207*c*, it is possible to keep the pressure roller 52 pressed upon, or separated from, the fixation roller 51. In this embodiment, the total amount of pressure applied to the pressure roller 52 to keep the pressure roller 52 pressed upon the fixation roller 51 is roughly 60 kgf. The application of this amount of pressure to the pressure roller 52 creates the fixation nip N which is roughly 10 mm wide in terms of the recording-medium conveyance direction. When the pressure roller 52 is kept separated from the fixation roller 51, the distance between the two rollers 51 and 52 is roughly 2 mm. The primary objects of the pressure roller moving means 207 are to make it easier for a user to deal with paper jam or the like, to extend the fixing members in service life, to prevent the pressure roller 52 from excessively increasing in temperature while no sheet of the recording medium is conveyed through the fixation nip N, or the like. According to the present invention, the pressure roller moving means 207 is made to play an important role to improve the cooling means of the fixing device in efficiency.

TABLE 1

| PR1NT1NG | | | | | |
|---|---|---|---|---|---|
| | B.W. | Target T. | | Discrimination T. | |
| Material | (g/m2) | F. roller | P. roller | F. roller | P. roller |
| Thick 2 | 181~256 | 190° C. | 100° C. | 190° C. | 100° C.~120° C. |
| Thick 1 | 106~180 | 185° C. | 100° C. | 185° C. | 100° C.~120° C. |

TABLE 1-continued

| | | | | | |
|---|---|---|---|---|---|
| Plain 2 | 91~105 | 180° C. | 100° C. | 180° C. | 100° C.~120° C. |
| Plain | 64~90 | 175° C. | 100° C. | 175° C. | 100° C.~120° C. |
| Thin | 52~63 | 165° C. | 100° C. | 165° C. | 100° C.~120° C. |
| Coated | 106~180 | 170° C. | 100° C. | 170° C. | 100° C.~110° C. |

| STAND-BY Target T. | |
|---|---|
| F. roller | P. roller |
| 180° C. | 100° C. |

Table 1 is a temperature control table for the fixing device B in this embodiment. As a printing job is started, the controller 141 selects (sets) one of the temperature levels (target temperatures) based on the information about the sheet S of the recording medium inputted through the control panel 142, and controls the fixation roller 51 and pressure roller 52 in temperature. The target temperature for the fixation roller 51 is set (selected) to be satisfactory from the standpoint of both the recording medium conveyance and the image properties described above. That is, it is set so that the greater in basis weight the sheet S of the recording medium, the higher the set target temperature. As for the target temperature for the pressure roller 52, it is to be set to 100° C. regardless of recording-medium type to make it basically unnecessary to change the pressure roller 52 in temperature. However, it is preset in terms of temperature range in which a printing job may be started, for the following reason. That is, in an image forming operation in which multiple prints are made, the temperature of the pressure roller is increased by the heat from the fixation roller 51 during the interval between the sequential two sheets S, and the extent of the temperature increase is affected by the length of the interval. Here, the sheet interval means the length of time between when the trailing edge of one of the continuously fed sheets S of the recording medium enters the fixation nip N, and when the leading edge of the following sheet S of the recording medium enters the fixation nip N. In this embodiment, when the recording medium is uncoated paper, the top limit for the temperature for the pressure roller 52 is set to 120° C. for the sake of recording-medium conveyance (to prevent the recording medium from being wrinkled and to ensure that the recording medium satisfactorily separates from pressure roller 52), wherein when the recording medium is coated paper, the top limit for the temperature of the pressure roller 52 is set to 110° C. to prevent the recording medium from blistering. Further, the default temperature setting for the fixation roller 51 of the fixing device B is 180° C., and that for the pressure roller 52 is 100° C. These settings are for making it possible for an image forming operation to be immediately started when the apparatus A is on standby, as long as the recording medium is Ordinary paper 2 in Table 2. Incidentally, the temperature for the standby period can be changed by registering one of the recording media other than Ordinary paper 2 as "frequently used recording medium" with the use of the control panel 142.

As described above, the temperature level at which printing may be actually started, or the temperature range in which printing may be actually started, are affected by the type (properties) of the sheet S of the recording medium selected as the recording medium for a given image forming operation. Therefore, after the completion of the given image forming operation, or as the on-going image forming operation in switched in the recording medium during a mixed recording-medium job, it sometimes becomes necessary to heat or cool the fixation roller 51 and the pressure roller 52 to change the fixation roller 51 and the pressure roller 52 in temperature to make their temperatures match the type of the recording medium. In particular, in the case of a fixing device, the fixation roller 51 and pressure roller 52 of which are large in thermal capacity, it takes a substantial length of time to cool the roller 51 and/or pressure roller 52 when it became necessary to cool them. In other words, the length of the standby time, that is, the length of time the apparatus A has to be kept on standby to change the temperature of the fixation roller 51 and/or pressure roller 52 to proper levels, is substantial, which is problematic. Thus, the primary object of the present invention is to make as short as possible the standby time for changing the fixation roller 51 and/or pressure roller 52 to proper levels. Next, the gist of the present invention is concretely described with reference to the preferred embodiments of the present invention.

Figure 4:
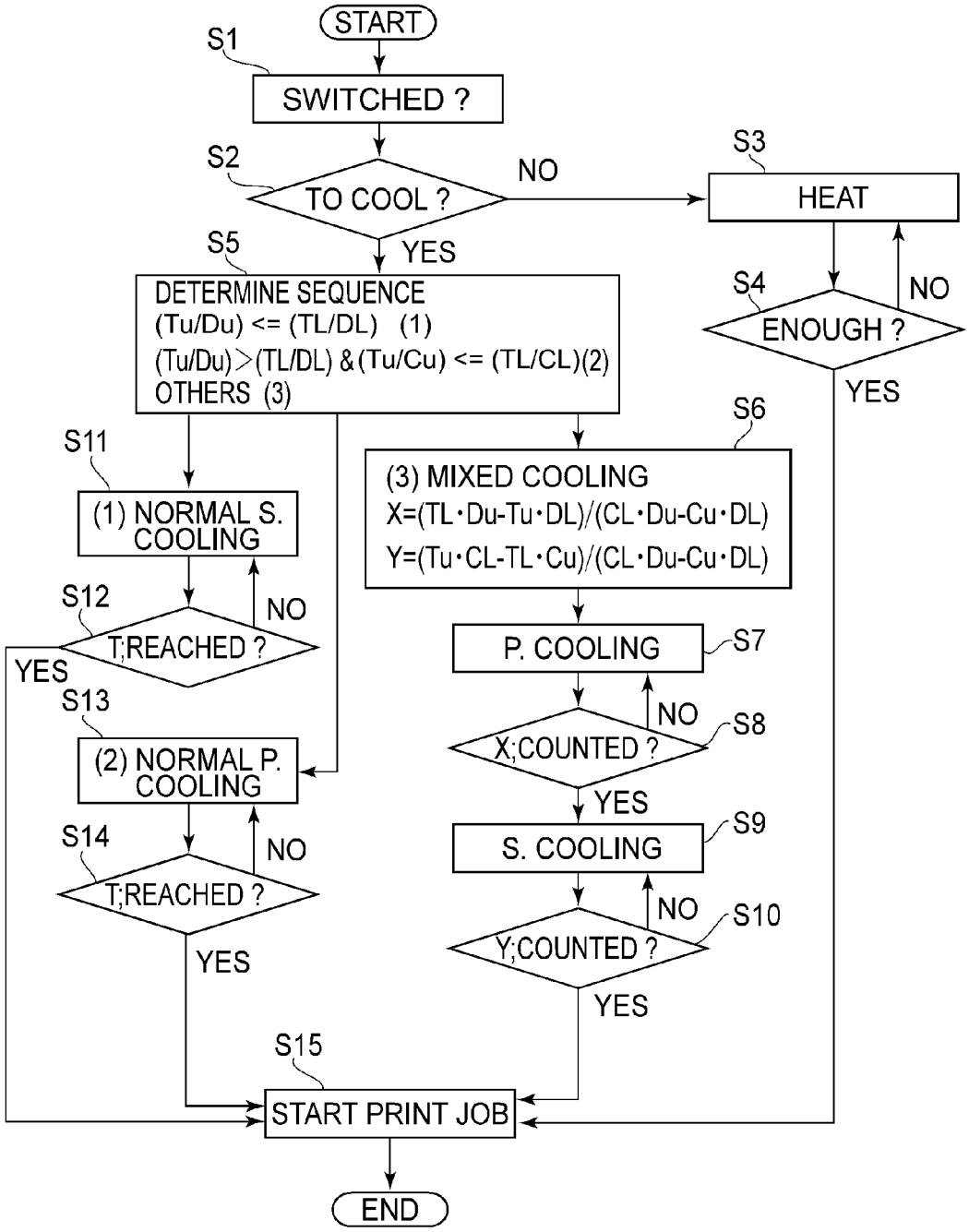
FIG. 4 is a flowchart of the operational sequence for controlling the fixing device in fixation temperature.

Referring to the flowchart in FIG. 4, the cooling control in this embodiment is concretely described. First, the cooling control for a "mixed sheet job", in which the recording medium is switched from thick paper to coated paper while two or more prints are continuously made, is described. Referring to Table 1, the target temperature for Thick paper 2 is 190° C./100° C. (fixation roller/pressure). As described above, the pressure roller 52 increases in temperature during each sheet interval in a job in which multiple prints are continuously made. Right after 200 sheets of thick paper were continuously conveyed through the fixation nip N of the fixing device B in this embodiment, the temperatures of the fixation roller 51 and the pressure roller 52 were 190° C. and 118° C., respectively. Thus, after the switching of the recording medium from thick paper to coated paper, it was necessary to cool both the fixation roller 51 and the pressure roller 52 in order to reduce their temperatures to 170° C. and 110° C., which is evident from Table 1, which shows the temperature ranges for the fixation roller 51 and the pressure roller 52, in which a job may be started.

The above-described decision is made by the controller 141. First, it is determined whether or not the two rollers 51 and 52 need to be cooled (Step S1). If the controller 141 determines that the cooling is unnecessary (Step S2), it activates the heating means 201 and/or 202 with the use of the temperature controlling means 200 (Step S3). If it determines that the temperatures of the two rollers 51 and 52 are at the target levels (Step S4), it makes the apparatus A to begin printing (Step S15). Usually, the cooling is unnecessary, and therefore, printing can be relatively quickly started. If the controller 141 determines in Step S2 that the rollers 51 and 52 need to be cooled, it selects one of the cooling sequences with the use of the cooling sequence selecting means 200A (Step S5). If it becomes necessary to reduce at least one of the fixation roller 51 and pressure roller 52 in temperature, the cooling sequence selecting means 200A (FIG. 2) of the temperature controlling means 200 selects the operational sequence for the cooling means 203 and 204 and the pressure roller moving means 207 in the following manner. That is, it selects the operational sequence that can minimize the length of time (standby time) necessary to change the temperatures of the fixation roller 51 and the pressure roller 52 to proper levels, based on the current temperatures of the two rollers 51 and 52, target temperatures of the two rollers 51 and 52, and cooling speeds Du, DL, Cu, and CL (Table 2) measured in advance.

TABLE 2

| COOLING SPEED | | |
|---|---|---|
| | Fixing roller | Pressing roller |
| Spaced state | Du: −0.4 (deg/sec) | DL: −0.6 (deg/sec) |
| Contacted state | Cu: −1.8 (deg/sec) | CL: +2.3 (deg/sec) |

Roughly speaking, the cooling speeds of the fixation roller 51 and the pressure roller 52 are determined by the structure of the fixing device B, the positioning of the cooling means 203 and 204, and the performance of the cooling means 203 and 204. In this embodiment, therefore, the values in Table 1 were used. In a case where the cooling speeds are changed by the ambient temperature of the apparatus A, the print count of the immediately preceding job, and/or the length of time required for the immediately preceding job, it is necessary to prepare a table that is more elaborate than Table 1, or these information may be factored into the computation formula for the cooling sequence selecting means 200A. In this embodiment, the cooling sequence selecting means 200A is provided with a cooling-speed table (Table 1) which contains the values for the cooling speeds Du, DL, Cu and CL, which are used by the cooling sequence selecting means 200A to select one of the three cooling sequence by computation. The values in this table are altered in response to the temperatures detected an ambient temperature detecting means 211 (FIG. 2), which is independent from the aforementioned temperature detecting means 205 and 206. Further, the cooling sequence selecting means 200A is also provided with a cooling speed table (Table 2) that contains the values for the cooling speeds DU, DL, Cu and CL, which also are used by the cooling sequence selecting means 200A to select one of the three cooling sequences by computation. The values in this table are altered in response to the print count of the print job carried out immediately before the fixation roller 51 and/or the pressure roller 52 begins to be cooled, or the length of time required to complete the immediately preceding job.

As is evident from the cooling speeds given in Table 2, when there is a gap between the fixation roller 51 and the pressure roller 52, the two rollers 51 and 52 slowly cool, whereas when the pressure roller 52 is kept pressed upon the fixation roller 51, the fixation roller 51 quickly cools, but the pressure roller 52 increases in temperature. The cooling sequence selecting means 200A uses this unique phenomenon to determine the proper ratio between the length of time for the separation cooling and that for the contact cooling.

In this embodiment, there are three cooling operation sequences selectable by the cooling sequence selecting means 200A, which are: (1) Separation cooling sequence, (2) Contact cooling sequence, and (3) Combination cooling sequence. That is, the cooling sequence selecting means 200A selects one among (1) Separation cooling sequence, (2) Contact cooling Sequence, and (3) Combination cooling sequence, using the following inequalities which include the aforementioned cooling speeds prepared in advance.

<Inequalities Used in Step S5>

$(Tu/Du) \leq (TL/DL) \rightarrow$ (1) Separation cooling sequence $(Tu/Du) > (TL/DL)$ and $(Tu/Cu) \leq (TL/CL) \rightarrow$ (2) Contact cooling Sequence Other conditions → (3) Combination cooling sequence.

Tu (deg): (target temperature−current temperature) of first fixing member 51

TL (deg): (target temperature−current temperature) of second fixing member 52

Du (deg/sec): separation cooling speed of first fixing member 51

DL (deg/sec): separation cooling speed of second fixing member 52

Cu (deg/sec): contact cooling speed of first fixing member 51

CL (deg/sec): contact cooling speed of second fixing member 52.

As the terms in the above given inequalities are substituted by the values in the tables in this embodiment, the temperatures of the fixation roller 51 and the pressure roller 52 immediately after the completion of a printing operation, which used Thick paper 2 as the recording medium, were 190° C. and 118° C., respectively, and the cooling target temperatures for the fixation roller 51 and the pressure roller 52 were 170° C. and 110° C., which are suitable for coated paper. Therefore, $$Tu = 170 - 190 = -20 \text{ (deg)}$$

$$TL = 110 - 118 = -8 \text{ (deg)}$$

$$(Tu/Du) = (-20/-0.4) = 50$$

$$(TL/DL) = (-8/-0.6) = 13.3$$

$$(Tu/Cu) = (-20/-1.8) = 11.1$$

$$(TL/CL) = (-8/+2.3) = -3.5$$

In other words, neither inequality (1) nor inequality (2) was satisfied. Therefore, the cooling sequence selecting means 200A selected the combination cooling sequence, which is the combination of the separation cooling sequence and contact cooling sequence. Further, in Step S6, it sets a proper ratio between the length time for the contact cooling sequence and that for the separation cooling sequence.

In this embodiment, as (3) Combination cooling sequence is selected as the cooling sequence for the fixing device, the length X of time (seconds) for the contact cooling sequence and the length Y of time (seconds) for the separation cooling sequence are obtained by the cooling sequence selecting means 200A with the use of the following equations.

Computation of length of contact cooling sequence and length of separation cooling sequence in Step S6

<Equations>

$$\text{Contact cooling sequence length } X = (TL \times Du - Tu \times DL)/(CL \times Du - Cu \times DL)$$

$$\text{Separation cooling sequence length } Y = (Tu \times CL - TL \times Cu)/(CL \times Du - Cu \times DL)$$

Substituting the values in the Tables in this embodiment for the terms in the equation given above, $$\text{Contact cooling sequence length } X = \{(-8) \times (-0.4) - (-20) \times (-0.6)\}/(-2) = 4.4$$

$$\text{Separation cooling sequence length } Y = \{(-20) \times (2.3) - (-8) \times (-1.8)\}/(-2) = 30.2$$

In this embodiment, therefore, as soon as the completion of the printing on Thick Paper 2, the contact cooling sequence was carried out 4.4 seconds (Steps S7 and S8). Then, the pressure roller moving means 207 was activated, and the fixation roller 51 and the pressure roller 52 were cooled for 30.2 seconds with the pressure roller 52 kept separated from the fixation roller 51 (Steps S9 and S10). With this practice, it takes, theoretically, 34.6 seconds (standby time) to reduce the temperatures of the fixation roller 51 and the pressure roller 52 to 170° C. and 110° C., respectively, which are suitable for coated paper. After the reduction of the two rollers 51 and 52 in temperature to the above levels, the apparatus A can move into the next phase of the mixed recording-medium image forming operation (Step S15).

Figure 5:
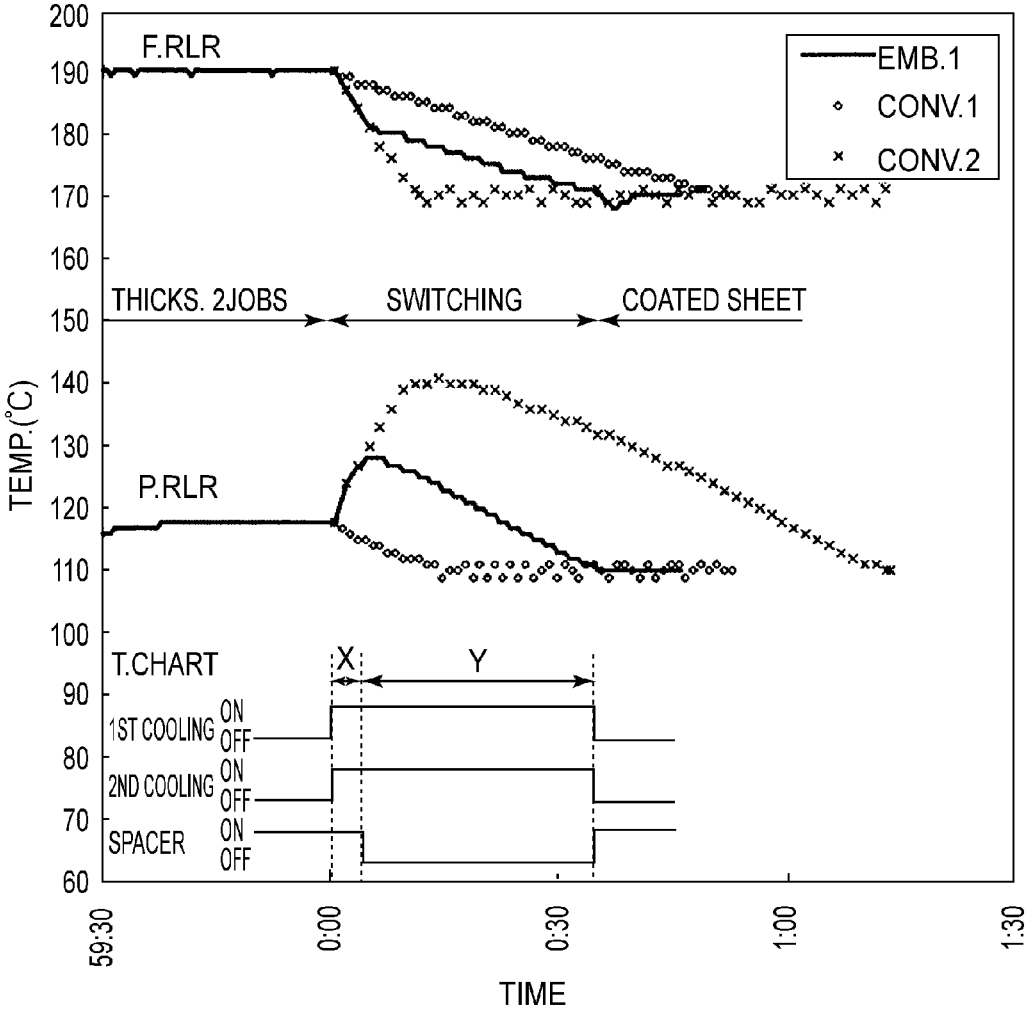
FIG. 5 is a combination of a graph that shows the temperature changes which occurred to the fixation roller and pressure roller as the fixing device was changed in fixation temperature (target temperature), and the timing chart for the first and second cooling means and pressure applying means moving means, in the first embodiment.

FIG. 5 is a graph which shows the changes that occurred to the temperatures of the fixation roller 51 and the pressure roller 52 when the two rollers 51 and 52 were changed in target temperature, in the first embodiment. The following is evident from the graph: Since the ratio between the length of time for the contact cooling sequence and that for the separation cooling sequence was properly set by the cooling sequence selecting means 200A, the fixation roller 51 and the pressure roller 52 roughly simultaneously reached their target temperatures, and the total length of the standby time was roughly 35 seconds, which is roughly equal to the minimum length of time achievable for the standby time. The dotted lines in the graph represent the changes in the temperatures of the fixation roller 51 and the pressure roller 52 which occurred to the examples of a conventional fixing device (fixing device in accordance with the prior art) during the cooling period. In the case of the first example of the conventional fixing device which uses only the separation cooling sequence, the length of time required to reduce the temperatures of the fixation roller 51 and the pressure roller 52 to their proper levels was roughly 50 seconds, whereas in the case of the second example of the conventional fixing device, which first reduces the temperature of the first fixation roller 51 to the target level through the contact cooling sequence, and then, reduces the temperature of the pressure roller 52 to its target level through the separation cooling sequence, it took roughly 70 seconds. That is, compared to the fixing device B in this embodiment, the examples of the conventional fixing device required a significantly longer standby time, thereby verifying the effects of the present invention.

In this embodiment, as (3) Combination cooling sequence is selected, whether or not the contact cooling sequence or the separation cooling sequence is ended, is determined based on the values obtained in advance by computation. However, for the following reason, it may be determined based on whether or not the temperatures of the two rollers 51 and 52 have decreased to the temperature levels that also can be obtained in advance by calculation. That is, the cooling speed of the two rollers 51 and 52 is affected by external factors as described above. Thus, it is possible that it sometimes takes less time for the temperatures of the two rollers 51 and 52 to decrease to the target temperatures than the precalculated (predicted) length of time. Further, since the order in which the contact cooling sequence and the separation cooling sequence are carried may be opposite from the order in this embodiment, and the results of the reversal are the same as those in this embodiment.

Embodiment 2

The second preferred embodiment of the present invention is an example of a case in which a fixing device in accordance with the present invention is operated according to a flowchart similar to the one in FIG. 4, which was used in the first embodiment. More concretely, also in the second embodiment, the fixing device in accordance with the present invention was used for a mixed medium job in which multiple prints were "continuously" made using Ordinary Paper 1 and Coated Paper. In this embodiment, however, the operation was started with the use of Ordinary Paper 1 as the recording medium, and then, was switched in the recording medium to Coated Paper. Right after the 300th sheet of Ordinary Paper 1 was conveyed through the fixation nip N, the temperatures of the fixation roller 51 and the pressure roller 52 were 175° C. and 119° C., respectively. Thus, in order to use Coated Paper, the two rollers 51 and 52 had to be cooled to 170° C. and 110° C. (Table 1), respectively, as they were in the first embodiment. Thus, the cooling sequence selecting means 200A substituted these values for the terms in the equations given above (Step S5 in FIG. 4), and selected (1) Separation cooling sequence (Steps S11 and S12):

$$Tu=170-175=-5 \text{ (deg)}$$

$$TL=110-119=-9 \text{ (deg)}$$

$$(Tu/Du)=(-5/-0.4)=12.5$$

$$(TL/DL)=(-9/-0.6)=15.$$

Figure 6:
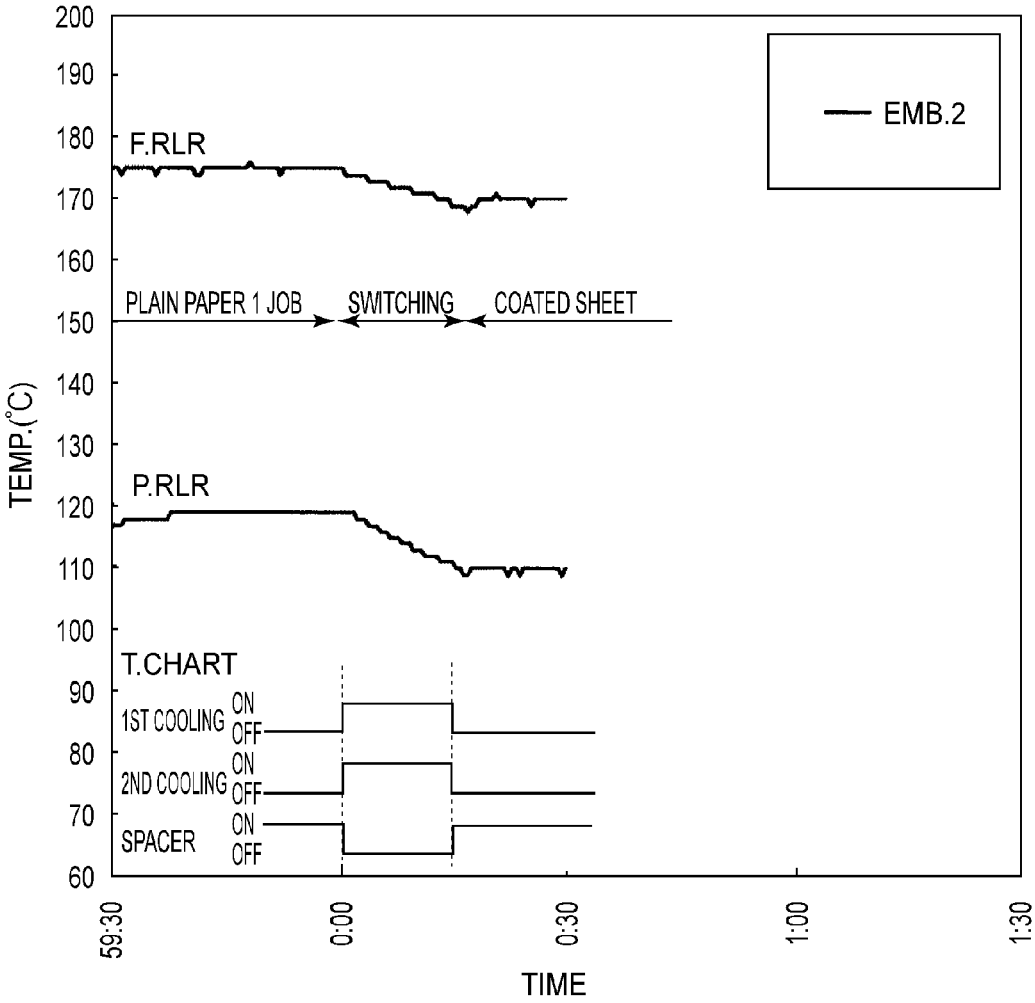
FIG. 6 is a combination of a graph that shows the temperature changes which occurred to the fixation roller and pressure roller as the fixing device was changed in fixation temperature (target temperature), and the timing chart for the first and second cooling means and pressure applying means moving means, in the second embodiment.

As is evident from the values obtained by the heating-sequence selection equations, if the cooling sequence selecting means 200A determines that it takes longer to cool the pressure roller 52 than the fixation roller 51, it selects the separation cooling sequence, for the following reason. That is, if the contact cooling sequence is used, the pressure roller 52 is increased in temperature, and therefore, the overall length of time it takes to cool the two rollers 51 and 52 becomes longer. Thus, there is no choice but selecting the separation cooling sequence. FIG. 6 shows the changes in the temperatures of the fixation roller 51 and the pressure roller 52 that occurred during the cooling period, and the timing with which the first and second cooling fans 203 and 204 were turned on and off.

Embodiment 3

This embodiment is different in the fixing-means cooling sequence from the first and second embodiment, in that an image forming operation which uses thin paper as assessment medium is started when the image forming apparatus (fixing device) is on standby. The default temperatures for the fixation roller 51 and the pressure roller 52, that is, the temperature levels at which the temperatures of the two rollers 51 and 52 are kept when the apparatus A is on standby, were 180° C. and 100° C. The top temperature limits for the fixation roller 51 and the pressure roller 52 for Thin Paper were 165° C. and 120° C., respectively. Therefore, the cooling sequence selecting means 200A selected one among the three cooling sequences in the following manner (Step S5 in FIG. 4).

$$Tu=165-180=-15 \text{ (deg)}$$

$$TL=120-100=+20 \text{ (deg)}$$

$$(Tu/Du)=(-15/-0.4)=+37.5$$

$$(TL/DL)=(+20/-0.6)=-33.3$$

$$(Tu/Cu)=(-15/-1.8)=8.3$$

$$(TL/CL)=(+20/+2.3)=8.7$$

Figure 7:
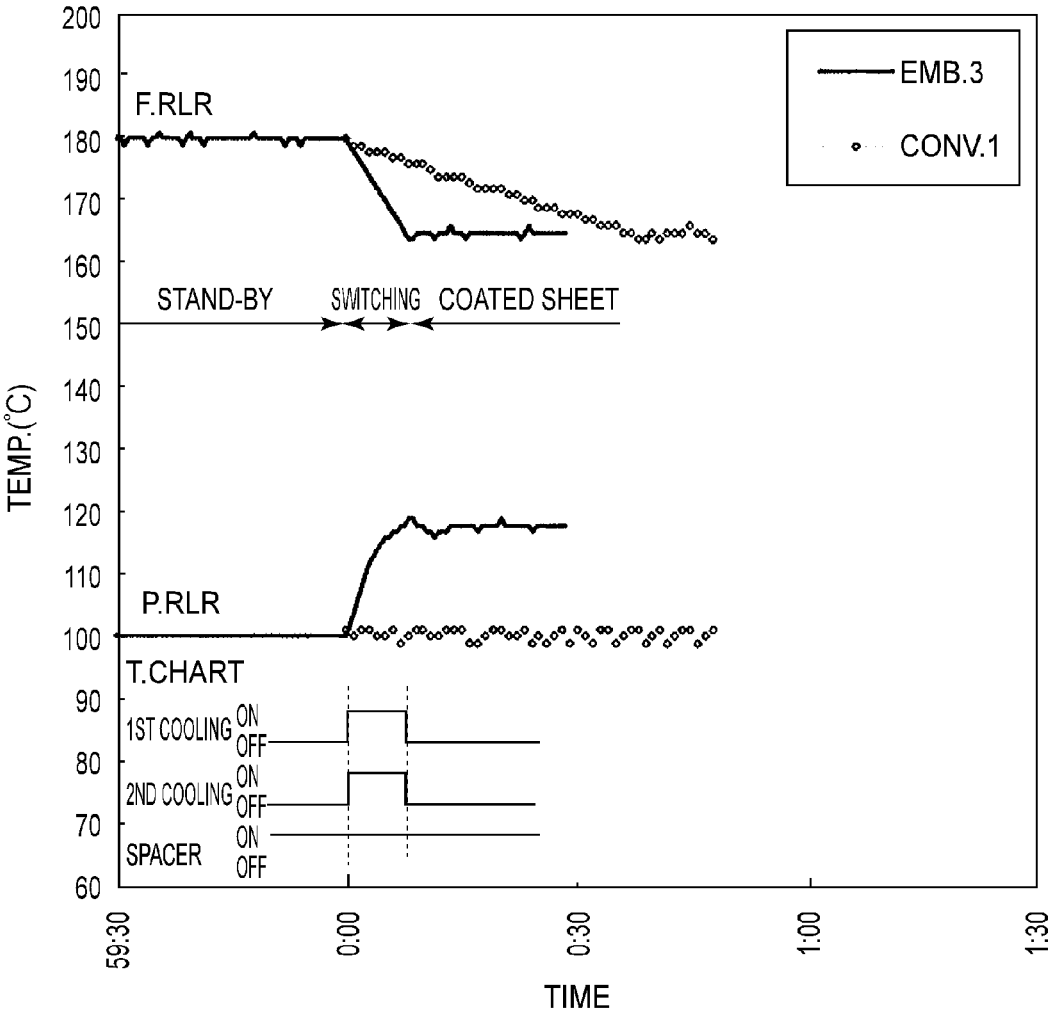
FIG. 7 is a combination of a graph that shows the temperature changes which occurred to the fixation roller and pressure roller as the fixing device was changed in fixation temperature (target temperature), and the timing chart for the first and second cooling means and pressure applying means moving means, in the third embodiment.

Therefore, in order to satisfy Inequality (2), the cooling sequence selecting means 200A selected (2) Contact cooling sequence (Steps S13 and S14). It was a decision made based on the assessment that the temperature increase which occurs to the pressure roller 51 as the contact cooling sequence is selected to maximize the efficiency with which the fixation roller 51 is cooled is permissible. FIG. 7 is a combination of a graph which shows the changes in the temperatures of the fixation roller 51 and the pressure roller 52 that occurred during the contact cooling sequence, and the timing charts for the first and second cooling means and pressure roller moving means. It is evident from FIG. 7 that the application of the present invention made the temperature of the fixation roller 51 decrease to its target level in very short length of time, or roughly eight seconds. If a decision-making process such as the one described above is not carried out, and the fixation roller 51 is cooled through the separation cooling sequence alone, a standby period of roughly 40 seconds is necessary as in the first embodiment. That is, the third embodiment of the present invention also verified the effectiveness of the present invention.

The following is the summary of the description of the fixing devices in the first to third preferred embodiments of the present invention. Each fixing device B has: the fixing means 51 which fixes the image t to a sheet S of a recording medium with the use of heat; and the pressure applying means 52 that is pressed upon the fixing means to form the nip N, through which the sheet S of the recording medium is conveyed while remaining pinched between the fixing means and the pressure applying means. It has also: the temperature detecting means 205 which detects the temperature of the fixing means; and electric power delivery controlling means 200 which controls the electric power delivery to the fixing means in response to the output of the temperature detecting means so that the temperature of the fixing means reaches, and remains at, its target level. Further, it has: the first cooling means 203 for cooling the surface of the fixing means; second cooling means 204 for cooling the surface of the pressure applying means; and pressure roller moving means 207 which places the pressure applying means in contact, or separates from, the fixing means. It can be operated in the first, second, and third cooling modes. The first cooling mode is such a cooling mode that the pressure applying means is pressed upon the fixing means, and at least the first cooling means is activated to cool the fixing means while both the fixing means and the pressure applying means are rotated. The second cooling mode is a cooling mode that is to be used to cool the fixing means when the pressure applying means is higher in temperature than the fixing means. In the second cooling mode, the pressure applying means is kept separated from the fixing means, and both the fixing means and pressure applying means are rotated. Further, both the first and second cooling means are activated. The apparatus A is provided with the controller 141 that determines whether the fixing device B is to be operated in the first or second mode. The controller 141 can also operate the fixing device B in the third cooling mode. In the third cooling mode, first, the pressure applying means is kept pressed upon the fixing means, and both the fixing means and the pressure applying means are rotated. Further, at least the first cooling means is activated. Then, the pressure applying means is separated from the fixing means, and both the first and second cooling means are activated while rotating both the fixing means and the pressure applying means.

To sum it up, as is evident from the above given description of the first to third preferred embodiments of the present invention, if it is necessary to cool the fixing means after the fixing device is changed in fixation temperature, the operational sequences for the cooling means 203 and pressure roller separating means 207 of the fixing device are selected based on the results of the computation done by the cooling sequence selecting means 200A based on the current temperatures of the fixation roller 51 and the pressure roller 52, target temperatures of the fixation roller 51 and the pressure roller 52, and known cooling speeds of the fixation roller 51 and the pressure roller 52. Thus, the temperature of the fixing means reaches its target level in the shortest time (standby time) achievable within the performance range of the fixing device.

Miscellaneous Embodiments

1) The first to third embodiments were described with reference to a fixing device of the so-called roller type, that is, a fixing device, the fixing members of which are two rollers and are pressed against each other. However, the present invention is also applicable to a fixing device of the so-called belt type, that is, a fixing device, one or both the fixing members of which are a combination of a circularly movable endless belt and a pressure applying member positioned inward side of the belt loop to form a fixation nip.

2) The present invention is also applicable to a fixing device structured so that the temperature detecting means 205 and 206 detect the temperature of the temperature of the inward surface of the fixing member 51 and that of the pressure applying member 52.

3) Each of the image forming apparatuses in the first to third embodiments was a color printer of the so-called tandem type and also, of the intermediary transfer type, that is, a color printer which has multiple image forming stations and an intermediary transfer member, and in which the image forming stations are positioned in parallel along the intermediary transfer member. However, image forming apparatuses to which the present invention is applicable is not limited to those in the first to third embodiments. For example, the present invention is applicable to a color printer of the so-called single-drum type, which has an the intermediary transfer member, that is, a color printer that has only a single drum (image bearing member) and an intermediary transfer member, and in which multiple monochromatic toner images, different in color, are sequentially formed on the single drum (image bearing member) and transferred onto the intermediary transfer member; and a color printer of the so-called tandem type, which does not have an intermediary transfer member, that is, a color printer of the so-called direct transfer type, which has multiple image bearing members, and in which multiple monochromatic toner images, different in color, are directly transferred from the image bearing member or image bearing members, onto the final recording medium. Further, the present invention is also applicable to image forming apparatuses other than a printer. That is, it is applicable to a copying machine, and a facsimile machine, for example.

4) In the first to third embodiments, the fixing devices were structured to use the cooling speed of the image fixing members to maximize the fixing device in efficiency. However, the application of the present invention is not limited to a fixing device structured as the fixing devices in the first to third embodiments. For example, the present invention is applicable to a fixing device structure so that one among the following three cooling mode is selected according to the state of the fixing device prior to the starting of the cooling sequence.

First cooling mode: Fixing means and pressure applying means are placed in contact with each other, and at least the first cooling means, that is, the cooling means for fixing means, is activated while rotating both the fixing means and pressure applying means.

Second cooling mode: Fixing means and pressure applying means are kept separated from each other, and both the first and second cooling means are activated while rotating both the fixing means and pressure applying means.

Third cooling mode: First, the fixing means and pressure applying means are kept pressed against each other, and at least the first cooling means is activated while rotating both the fixing means and pressure applying means; then, fixing means and pressure applying means are separated, and kept separated, from each other, and both the first cooling means, that is, the cooling means for cooling the fixing means, and the second cooling means, that is, the cooling means for cooling the pressure applying means, are activated while rotating both the fixing means and pressure applying means.

For example, if the fixing device is on standby and the pressure applying means is relatively low in temperature, the first cooling mode is selected. If the fixation temperature is lower than that for the thick paper mode which requires a large amount of heat, and/or the amount by which the fixation roller is to be reduced in temperature is relatively small, the second cooling mode is selected. Further, if the amount by which the temperature of the pressure applying means decreases is relatively large, the third cooling mode is selected.

Further, the present invention is also applicable to a fixing device structured so that the temperature of its pressure applying means is detected, and one of the cooling modes is selected based on the detected temperature of the pressure applying means. The results of such application are the same as those obtained by the fixing devices in the first to third embodiments. More concretely, the first temperature value, and the second temperature value, which is higher than the first temperature value, are stored in advance in a memory (RAM). If the temperature of the pressure applying means is higher than the first value, the first cooling mode is selected. If the temperature of the pressure applying means is between the first and second temperature values, the second cooling mode is selected. Further, if the temperature of the pressure applying means is higher than the second temperature value, the third cooling mode is selected. The effects of the application of the present invention to a fixing device structured as described above are the same as those obtained by the fixing devices in the first and third embodiments.

As described above, according to the present invention, in a case where the temperature of the pressure applying means is low, the fixing means is increased in the speed with which the fixing means is reduced in temperature. Further, even if the pressure applying means is relatively high, the fixing means and pressure applying means can be cooled together.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 2010-169158 filed Jul. 28, 2010 which is hereby incorporated by reference.

What is claimed is:

1. An image heating apparatus for heating an image on a recording material, said apparatus comprising:

an image heating device configured to heat an image on the recording material;

a pressing device configured to press against said image heating device to form a nip for nipping and feeding the recording material;

a first temperature detector configured to detect the temperature of said image heating device;

an electric power supply controller configured to control electric power supply to said image heating device in accordance with an output of the first temperature detector so that the temperature of said image heating device is a target temperature;

a second temperature detector configured to detect a temperature of said pressing device;

a first cooling device configured to cool a surface of said image heating device;

a second cooling device configured to cool a surface of said pressing device;

a contact-spacing device configured to establish a contact state in which said image heating device and said pressing device contact each other and a spaced state in which said image heating device and said pressing device are spaced from each other;

an executing portion configured to execute a first cooling mode operation in which at least one of said cooling devices is operated while rotating said image heating device and said pressing device in the contact state and a second cooling mode operation in which said first cooling device and said second cooling device are operated while rotating said image heating device and said pressing device in the spaced state; and a selector configured to select from cooling modes including the first cooling mode and the second cooling mode on the basis of an output of said second temperature detector.

2. An apparatus according to claim 1, wherein said executing portion is capable of executing a third cooling mode operation in which at least said first cooling device is operated while rotating said image heating device and said pressing device in the contact state, and then said first cooling device and said second cooling device are operated while rotating said image heating device and said pressing device in the spaced state.

3. An apparatus according to claim 1, wherein said selector selects a cooling mode using the difference between a detected temperature of said first temperature detector and a target temperature of image heating device and the difference between a detected temperature of said second temperature detector and a target temperature of said pressing device.

4. An apparatus according to claim 3, wherein said selector selects the first cooling mode when a predicted time for the detected temperature of first temperature detector to reach the target temperature of said image heating device is not more than a predicted time for the detected temperature of second temperature detector to reach the target temperature of said pressing device in a state that said first cooling device and said second cooling device are operated in the spaced state.

5. An apparatus according to claim 4, wherein said selector selects the second cooling mode when a predicted time for the detected temperature of first temperature detector to reach the target temperature of said image heating device in the state that said first cooling device and said second cooling device are operated in the spaced state is more than a predicted time for the detected temperature of said second temperature detector to reach the target temperature of said pressing device, and a predicted time for the detected temperature of said first temperature detector to reach the target temperature of said image heating device is not more than a predicted time for the detected temperature of said second temperature detector to reach the target temperature of said pressing device in the state that said first cooling device and said second cooling device are operated in the contact state.

* * * * *